US006085899A

United States Patent [19]

Thorsbakken

[11] Patent Number: 6,085,899

[45] Date of Patent: Jul. 11, 2000

[54] WET AND DRY TISSUE DISPENSER

[76] Inventor: Arden L. Thorsbakken, Rt. 6, 4204 Tamara Dr., Eau Claire, Wis. 54701

[21] Appl. No.: 08/943,942

[22] Filed: Oct. 3, 1997

[51] Int. Cl.[7] ..... A47K 10/32

[52] U.S. Cl. ..... 206/205; 206/233; 206/409; 225/42; 225/43

[58] Field of Search ..... 206/205, 233, 206/216, 409, 389, 494, 812; 118/43, 325; 225/39–52

[56] References Cited

U.S. PATENT DOCUMENTS

| | | | |
|---|---|---|---|
| 2,440,974 | 5/1948 | Resch | 206/205 |
| 2,613,879 | 10/1952 | Carr, Jr. | 225/43 |
| 2,759,830 | 8/1956 | Touceda | 206/205 |
| 3,368,522 | 2/1968 | Cordis | 118/43 |
| 3,868,052 | 2/1975 | Rockefeller . | |
| 3,910,229 | 10/1975 | Spencer | 118/325 |
| 3,982,659 | 9/1976 | Ross . | |
| 3,986,479 | 10/1976 | Bonk . | |
| 4,262,816 | 4/1981 | Margulies . | |
| 4,328,907 | 5/1982 | Beard . | |
| 4,648,530 | 3/1987 | Granger . | |
| 4,936,452 | 6/1990 | Pauley | 206/409 |
| 5,509,593 | 4/1996 | Bloch et al. . | |
| 5,660,313 | 8/1997 | Newbold | 206/409 |

*Primary Examiner*—Paul T. Sewell
*Assistant Examiner*—Luan K. Bui
*Attorney, Agent, or Firm*—Skinner and Associates

[57] ABSTRACT

A tissue dispenser for dispensing either dry or partially wet and partially dry segments of tissues. The tissue dispenser generally comprises a housing having a tissue egress passage, a tissue source of a predetermined quantity of dry tissue located in the housing, a fluid source of a predetermined volume of fluid located in the housing, and an actuatable application mechanism in fluid communication with the fluid source and operationally positioned proximate to the tissue egress passage. The application mechanism can be actuated to dispense fluid onto the tissue as the tissue passes through the tissue egress passage. One partially wet and partially dry tissue can be used to clean and dry an article. The dispenser will dispense dry tissues if the application mechanism is not actuated while the tissue passes through the egress passage.

16 Claims, 2 Drawing Sheets

WET AND DRY TISSUE DISPENSER

BACKGROUND OF THE INVENTION

1. Field of the Invention.

The present invention relates, generally, to tissue dispensers. More particularly, the invention relates to apparatus for dispensing tissues that are optionally impregnated with a fluid.

2. Background Information.

The state of the art includes various devices and methods for dispensing tissues, such as those constructed from paper, cloth or gauze-type material. The tissue dispenser art includes packages of facial tissues, packages of moistened wipes such as baby wipes or facial wipes, and bandages. These tissues may contain or be impregnated with a type of fluid. Baby wipes may contain a mild soap-based cleaner, facial tissues may contain lotion, and bandages may contain an anti-bacterial agent. Furthermore, these tissues are packaged in different ways. For example, facial tissues and baby wipes are often boxed, and bandages and facial wipes are often individually packaged.

These devices and methods are believed to have significant limitations and shortcomings. Specifically, a tissue or cloth is typically either "wet" or "dry." However, a complete cleaning process requires the use of both a wet tissue to clean and / or disinfect a surface, and a dry tissue to dry the surface and remove debris. The cleaning process may entail carrying around a separate fluid supply for wetting and re-wetting the wet cloth, in addition to having to carry around both a wet and a dry cloth. Furthermore, the wet tissues have a tendency to dry out due to evaporation, which is a special concern with alcohol-based fluids like antiseptics because of the fast evaporation rate of alcohol. Even pre-moistened tissues stored in a sealed and relatively moisture resistant package tend to dry out over time. Therefore, wet tissues tend to have a relatively short shelf life. A further limitation of the known art is that it can be inconvenient, messy, and generally troublesome to wet or re-wet the tissue from a separate fluid supply, especially if concerned with the amount of fluid being absorbed by the tissue.

Block et al. (U.S. Pat. No. 5,509,593) show a combined wet and dry sanitary tissue dispenser that dispenses a roll of dry sanitary tissue from a first compartment and a roll of prewetted personal hygiene wipes from a second compartment. Margulies (U.S. Pat. No. 4,262,816) shows a package and dispensing device for a continuous roll of premoistened towelettes. Beard (U.S. Pat. No. 4,328,907) shows a dispenser form which individual, moistened paper tissues are pulled from a perforated source of tissue. Granger (U.S. Pat. No. 4,648,530) shows an automatic dispenser of pre-cut and z-wrapped or folded web materials. Bonk (U.S. Pat. No. 3,986,479) shows a premoistened towelette dispenser that utilizes a double lid and a pouch to prevent loss of moisture in the towelettes. Rockefeller (U.S. Pat. No. 3,868,052) shows a dispensing container for moist tissues. Ross (U.S. Pat. No. 3,982,659) shows a bulk package and dispensing device for substantially wet sheets.

Applicant's invention provides a wet and dry tissue dispenser which overcomes the limitations and shortcomings of the known art. It is a portable, self-contained device that can dispense completely dry tissue, and partially wet and partially dry tissue. In the case of the partially wet and partially dry embodiment, an appropriate amount of fluid is applied to the tissue for cleaning purposes, and an appropriate amount of tissue remains dry to both wipe a surface dry and to remove debris or grime from a surface. The dispenser prevents premature drying of the tissue by applying the fluid to the tissue as it is being dispensed, rather than dispensing pre-moistened or impregnated tissue. Furthermore, an embodiment of the dispenser allows an operator to easily adjust the amount of fluid being applied to a tissue by using a finger actuated compression mechanism.

BRIEF SUMMARY OF THE INVENTION

The present invention provides a wet and dry tissue dispenser which generally comprises: a housing having a tissue egress passage; a tissue source located in the housing, wherein dry tissue is disposed from the tissue source through the tissue egress passage; a fluid source located in the housing and having fluid communication to the tissue egress passage; and an actuation mechanism for applying fluid onto the tissue. In an alternative embodiment, the actuation mechanism includes a finger actuated compression mechanism, such as a flexible membrane button or a trigger, that allows an operator to expel a desired amount of fluid from the fluid source onto the tissue.

Significant features of the invention include: the self-contained design of the dispenser that incorporates a separate and distinct fluid source and a separate and distinct tissue source; the ability of the invention to dispense tissue either with or without applying the fluid to the tissue; the ability of the invention to dispense tissues of various length; and the ability of the invention to apply the desired amount of the fluid onto the tissue as it is being dispensed.

The features, benefits and objects of this invention will become clear to those skilled in the art by reference to the following description, claims and drawings.

DETAILED DESCRIPTION

Figure 1:
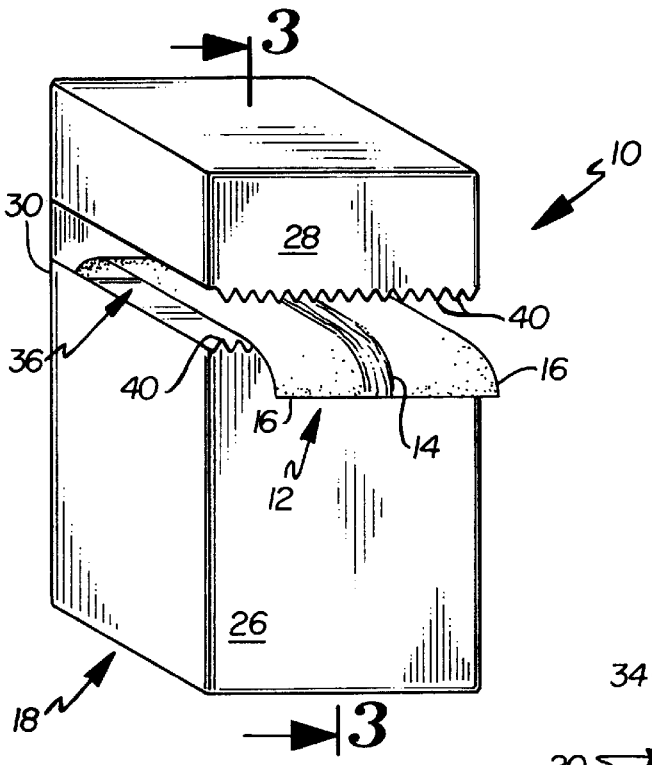
FIG. 1 is a perspective view of an embodiment of the wet and dry tissue dispenser.

Referring to FIGS. 1–5, an example of the preferred embodiment of the present invention is illustrated and generally indicated by the reference numeral 10. The tissue dispenser 10 is described below first in terms of its major structural elements and then in terms of its secondary structural and/or functional elements which cooperate to dispense wet, dry, or partially wet and partially dry tissues.

Figure 2:
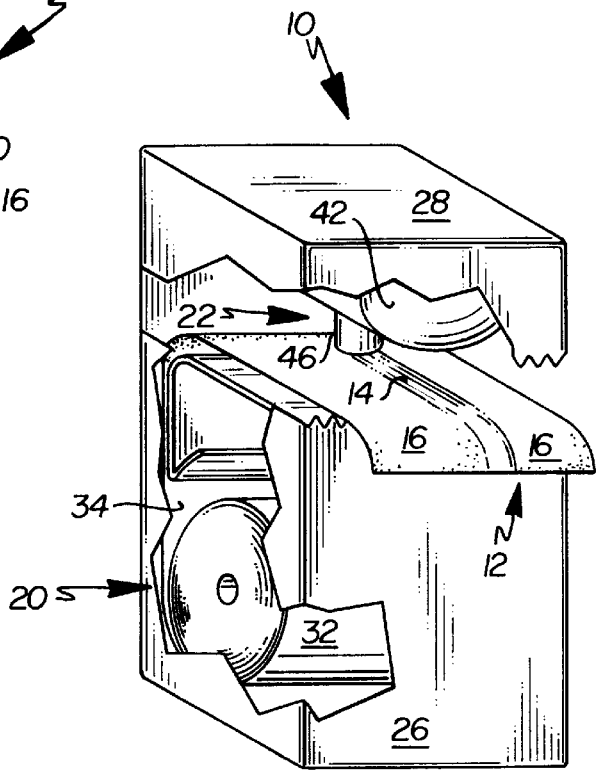
FIG. 2 is a perspective view, partially in cross-section, of the dispenser of FIG. 1.

Referring to FIGS. 1–2, the tissue dispenser 10 is shown dispensing a length of tissue or dispensed tissue segment 12. Fluid is applied onto the tissue as it is pulled or dispensed out of the dispenser 10. In the embodiment shown, the fluid is applied in such a manner as to dispense a tissue segment 12 having a generally centered wet portion 14 and two dry portions 16.

Figure 3:
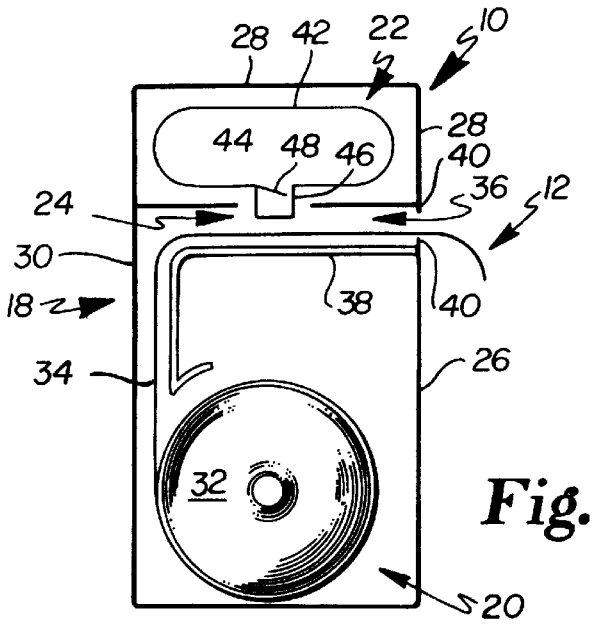
FIG. 3 is a cross-sectional view of the dispenser along line 3—3 of FIG. 1.
Figure 5:
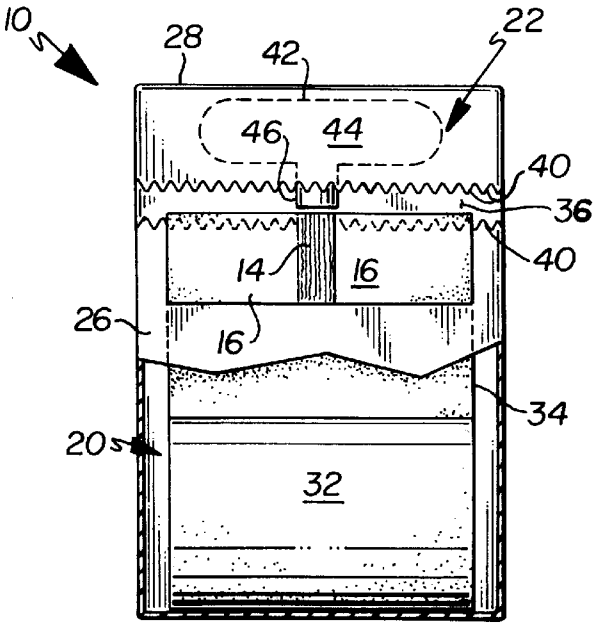
FIG. 5 is a front view of the dispenser.

FIG. 3 is a cross-sectional side view of the dispenser 10 along line 3—3 of FIG. 1. It shows the major elements of the dispenser 10 and how these elements interact to form a dispensed tissue segment 12 having a wet portion 14 and two dry portions 16. The dispenser 10 generally comprises a housing 18, a tissue source 20, a fluid source 22, and an application mechanism 24. The housing 18 of the preferred embodiment shown has a body portion 26 and a lid portion 28. The lid portion 28 is pivotally connected to the body portion 26 through a flexible hinge 30.

Figure 4:
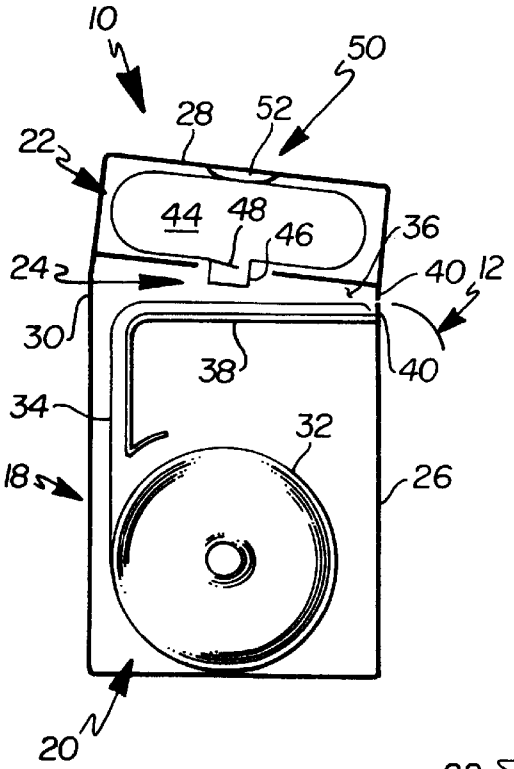
FIG. 4 is the cross-sectional view of FIG. 3 showing the dispenser cutting a tissue segment, and showing an embodiment of the finger actuated compression mechanism.

The tissue source 20 is a dry tissue roll 32, which is unwound into a draw segment 34 and is expelled from the dispenser 10 as a dispensed tissue segment 12. The draw segment 34 travels through a tissue egress passage 36 in the housing 18. A support element 38 forms part of the tissue egress passage 36. The support element 38 assists with maintaining the tissue roll 32 in place, guiding the draw segment 34 during the dispensing process, and supporting the draw segment 34 as fluid is applied by the application mechanism 24. As shown most clearly in FIG. 1, the housing 18 also contains a cutting bar 40 or serrated edge used to segment or cut the dispensed tissue segment 12. As shown in FIG. 4, the lid portion 28 of the housing 18 is manually pushed or pivoted down toward the body portion 26 to cut the dispensed tissue segment 12 to a desired length.

A preferred fluid source 22 is a bladder 42 having flexible walls. The bladder 42 contains a predetermined volume of fluid 44. The application mechanism 24 provides a controlled fluid communication means between the fluid source 22 and the tissue egress passage 36 where fluid 44 is applied to the draw segment 34. The application mechanism 24 includes at least one fluid exit orifice 46 or channel positioned near the tissue egress passage 36. The application mechanism may be actuatable in such a manner that it dispenses fluid onto the tissue if actuated by an operator and refrains from dispensing fluid onto the tissue if not actuated by the operator. Each orifice 46 contains a one-way valve 48 for dispensing fluid 44 onto the draw segment 34. The fluid 44 may be dispensed through gravitational force, capillary or sponge-like action, or through another compression or expansion force that expels the fluid 44 through a pressure sensitive one-way valve 48. For example, the application mechanism may apply a relatively constant amount of fluid onto the tissue when the tissue is pulled out of the dispenser 10 if the tissue rubs against the application mechanism 24. The application mechanism 24 also can dispense an adjustable amount of fluid 44 by using a finger actuated compression mechanism 50 to create a pressure differential between the inside and outside of the fluid source 22. FIG. 4 shows an embodiment of the dispenser 10 that includes a finger actuated compression mechanism 50 in the form of a flexible membrane button 52. It is anticipated that other finger-actuated compression mechanisms 50, such as a trigger device, could be used either to compress the bladder 42 to expel the fluid 44 or to extract the fluid 44 by suctioning it out of the fluid source 22.

In the embodiment shown in the figures, the tissue source 20 is located in the body portion 26 and the fluid source 22 is located in the lid portion 28. The tissue source 20 and fluid source 22 can be located in numerous different places within the housing 18, limited by the ability of the application mechanism 24 to apply fluid 44 onto the tissue. Since there are a number of suitable application mechanisms 24, there are also a number of possible arrangements of the tissue source, fluid source, and application member within any given housing design.

Figure 6:
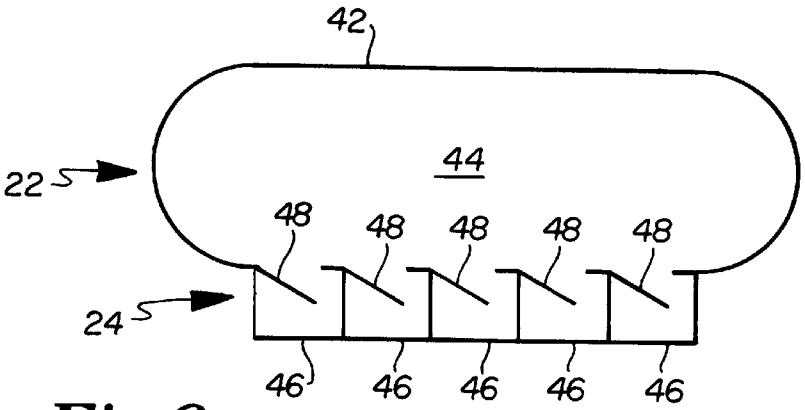
FIG. 6 is a plan view of an alternative fluid bladder containing multiple fluid orifices.

FIG. 6 shows an embodiment of a fluid source 22 or bladder 42 connected to multiple fluid exit orifices 46 and one-way valves 48. The arrangement of these orifices 46 determine the pattern of wet portions 14 and dry portions 16 on the dispensed tissue segment 12. Thus, the dispenser 10 could be designed to produce an all wet dispensed tissue segment 12 or a dispensed tissue segment 12 with a pattern of wet and dry areas. The dispenser 10 may also produce a dry dispensed tissue segment 12 simply by not applying fluid 44 onto the tissue.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. A tissue dispenser comprising:

(a) a housing having a tissue egress passage;

(b) a tissue source of a predetermined quantity of dry tissue located in said housing, said tissue being disposed through said tissue egress passage;

(c) a fluid source of a predetermined volume of fluid located in said housing; and (d) an application mechanism in fluid communication with said fluid source and operably positioned proximate to said tissue egress passage, wherein said application mechanism applies said fluid onto said tissue dispensed from said tissue source through said tissue egress passage.

2. The tissue dispenser of claim 1, wherein said housing includes a body portion and a lid portion, said lid portion being pivotally attached to said body portion.

3. The tissue dispenser of claim 1, wherein said housing includes a cutting bar for cutting said tissue into segments.

4. The tissue dispenser of claim 1, wherein said housing further includes a support element for guiding said tissue through said tissue egress passage and for supporting said tissue while said fluid is being applied by said application mechanism.

5. The tissue dispenser of claim 1, wherein said tissue source is a roll of dry tissue.

6. The tissue dispenser of claim 1, wherein said application mechanism is an actuatable application mechanism, wherein said actuatable application mechanism dispenses said fluid onto said tissue when actuated, and wherein said actuatable application mechanism does not dispense said fluid onto said tissue when not actuated.

7. The tissue dispenser of claim 6, wherein said actuatable application mechanism is a finger actuated compression device for expelling a desired amount of fluid.

8. The tissue dispenser of claim 7, wherein said fluid source has a flexible wall and said finger actuated compression device compresses said fluid source to expel said desired amount of fluid.

9. The tissue dispenser of claim 1, wherein said housing has a body portion and a lid portion pivotally connected to said body portion, and wherein said fluid source is located within said lid.

10. The tissue dispenser of claim 1, wherein said application mechanism and said tissue are designed and manufactured to apply a limited amount of said fluid to cause said tissue to have a defined wet portion and to maintain a defined dry portion.

11. The tissue dispenser of claim 1, wherein said application mechanism includes a one-way valve for permitting fluid flow out of said fluid source toward said tissue egress passage and onto said tissue.

12. The tissue dispenser of claim 11, wherein said one-way valve is pressure sensitive and permits fluid flow only upon the application of an external force.

13. The tissue dispenser of claim 12, wherein said external force is applied through a finger actuated compression device.

14. The tissue dispenser of claim 11, wherein said application mechanism further includes two or more one-way valves for dispensing fluid onto said tissue at two or more positions.

15. A tissue dispenser comprising:

(a) a housing having a tissue egress passage;

(b) a tissue source of a predetermined quantity of dry tissue located in said housing, said tissue being dispensed through said tissue egress passage;

(c) a fluid source of a predetermined volume of fluid located in said housing; and (d) an actuatable application mechanism in fluid communication with said fluid source and operably positioned proximate to said tissue egress passage, said application mechanism including a one-way, pressure-sensitive valve for permitting fluid flow out of said fluid source toward said tissue egress passage and onto said tissue upon the application of an external force.

16. A tissue dispenser comprising:

(a) a housing having a tissue egress passage, said housing having a body portion and a lid portion pivotally attached to said body portion, both of said body portion and said lid portion having a cutting bar for segmenting tissue, said body portion further having a support element forming part of said tissue egress passage;

(b) a tissue source of a predetermined quantity of dry tissue located in said body portion, said tissue source being a roll of dry tissue, wherein said tissue is unwound around said support element and dispensed through said tissue egress passage;

(c) a fluid source of a predetermined volume of fluid located in said lid portion; and (d) an actuatable application mechanism in fluid communication with said fluid source and operably positioned proximate to said tissue egress passage, said application mechanism including a one-way, pressure-sensitive valve for permitting fluid flow out of said fluid source toward said tissue egress passage and onto said tissue upon the application of an external force on said application mechanism.

* * * * *